US010043349B1

(12) United States Patent
Borruso

(10) Patent No.: US 10,043,349 B1
(45) Date of Patent: Aug. 7, 2018

(54) METHODS FOR CONDUCTING AND PLAYING A LOTTERY GAME

(71) Applicant: Ronald Borruso, Mesa, AZ (US)

(72) Inventor: Ronald Borruso, Mesa, AZ (US)

( * ) Notice: Subject to any disclaimer, the term of this patent is extended or adjusted under 35 U.S.C. 154(b) by 523 days.

(21) Appl. No.: 14/305,516

(22) Filed: Jun. 16, 2014

Related U.S. Application Data

(63) Continuation of application No. 13/367,684, filed on Feb. 7, 2012, which is a continuation-in-part of application No. 12/575,400, filed on Oct. 7, 2009.

(51) Int. Cl.
*A63F 3/00* (2006.01)
*G07F 17/32* (2006.01)

(52) U.S. Cl.
CPC ..... *G07F 17/329* (2013.01); *A63F 3/00* (2013.01)

(58) Field of Classification Search
CPC ..... A63F 3/06; A63F 3/08; G06F 17/00
See application file for complete search history.

(56) References Cited

U.S. PATENT DOCUMENTS

2001/0051539 A1* 12/2001 Zach ..... G06Q 50/34 463/17
2005/0064930 A1 3/2005 Jubinville
2006/0287055 A1 12/2006 Hamud

* cited by examiner

*Primary Examiner* — James S McClellan
*Assistant Examiner* — Syvila Weatherford
(74) *Attorney, Agent, or Firm* — Parsons & Goltry; Michael W. Goltry; Robert A. Parsons

(57) ABSTRACT

A lottery game playing method includes providing a numerical deviation factor, issuing a lottery ticket to a player imprinted with groups of chance numerals including a group of primary numerals and groups of option numerals. The number of primary numerals is equal to the number of option numerals of each group of option numerals. Each option numeral of each group of option numerals is the same as a positionally corresponding one of the primary numerals, or different from the positionally corresponding one of the primary numerals by the numerical deviation factor. The method next includes receiving from a drawing result numerals positionally corresponding to and equal in number to the number of primary numerals and the number of option numerals of each of the groups of option numerals, and assigning a win to the lottery ticket if the result numerals are the same one of the groups of chance numerals.

13 Claims, 1 Drawing Sheet

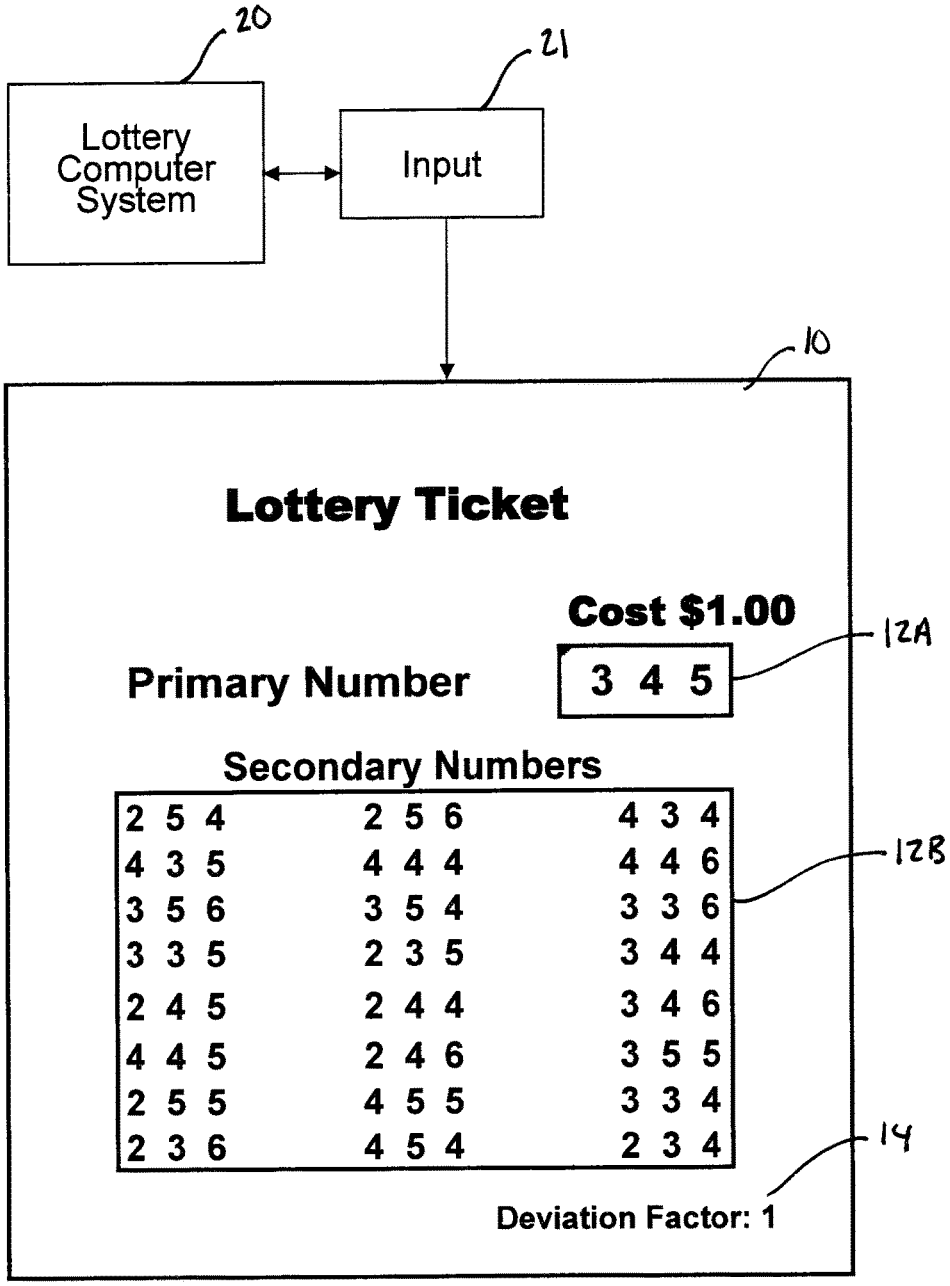
20
21
Lottery Computer System
Input
10
Lottery Ticket
Cost $1.00
12A
Primary Number
3 4 5
Secondary Numbers
2 5 4 2 5 6 4 3 4
4 3 5 4 4 4 4 4 6
3 5 6 3 5 4 3 3 6
3 3 5 2 3 5 3 4 4
2 4 5 2 4 4 3 4 6
4 4 5 2 4 6 3 5 5
2 5 5 4 5 5 3 3 4
2 3 6 4 5 4 2 3 4
12B
14
Deviation Factor: 1

METHODS FOR CONDUCTING AND PLAYING A LOTTERY GAME

FIELD OF THE INVENTION

This invention relates to lotteries.

BACKGROUND OF THE INVENTION

Lottery is a procedure for distributing something (usually money or prizes) among a group of people by lot or chance. The type of lottery considered here is a form of gambling in which a usually large number of people purchase chances called lottery tickets, in which the winning tickets are drawn from a pool composed of all tickets sold or offered for sale. The value of the prizes is the amount remaining after expenses, which include the profits for the promoter, the costs of promotion, the portion allocated to designated state purposes, and the taxes and other charges. In most large-scale lotteries, a very large prize is offered along with many smaller ones. Lotteries have a very wide appeal as a means for raising money; they are simple to organize, easy to plan, and, in general, popular but controversial.

The practice of determining the distribution of property by lot is traceable to ancient times. Among dozens of Biblical examples, the Old Testament (Numbers 26:55-56) has the Lord instructing Moses to take a census of the people of Israel and to divide the land among them by lot. The Roman emperors Nero and Augustus used lotteries to give away property and slaves during Saturnalian feasts and other entertainments. Modern lotteries of a similar type include those used for military conscription, commercial promotions in which property is given away by a random procedure, and the selection of jury members from lists of registered voters. Under the strict definition of a gambling type of lottery, however, payment of a consideration (property, work, or money) must be made for a chance of receiving the prize.

The basic elements of modern lotteries are usually quite simple. First, there must be some means of recording the identities of the bettors, the amounts staked by each, and the number or other symbol on which the money is bet. The bettor may write his name on a ticket that is deposited with the lottery organization for subsequent shuffling and possible selection in the drawing. Or the bettor may buy a numbered receipt, in the knowledge that this number will be entered into a pool of numbers, the bettor having the responsibility of determining later if his ticket was among the winners. Another procedure requires only that the bettor inform a representative of the lottery which number he guesses will be drawn, and the representative is trusted to appear later with the prize, if any is won. This is the usual procedure in the illegal numbers game, which has been popular for several decades in many cities throughout the United States.

A second element of all lotteries is the drawing, which is a procedure for determining winning numbers. This may take the form of a pool or collection of tickets or their counterfoils from which the winners are extracted. The tickets must first be thoroughly mixed by some mechanical means, such as shaking or tossing; this is a randomizing procedure designed to insure that chance and only chance determines the selection of winners. Computers have increasingly come into use for this purpose because of their capacity for storing information about large numbers of tickets and also for generating random numbers for identifying the winners. Promoters of public, especially of large-scale, lotteries may exploit the opportunity to make the drawing and/or mixing process as colorful and dramatic as possible.

The third element common to all lotteries is the existence of a mechanism for collecting and pooling all the money placed as stakes. This is usually accomplished by a hierarchy of sales agents who pass money paid for the tickets up through the organization until it is "banked." A practice common in many national lotteries is to divide tickets into fractions, usually tenths. Each fraction if and when it is sold separately costs slightly more than its share of the total cost of an entire ticket. Many people then buy whole tickets, in effect at a premium or discounted price, for marketing in the streets where customers can place relatively small stakes on the fractions. In a large-scale lottery, the use of the regular mail system is desirable for communicating information and transporting tickets and stakes. In the United States and some other countries, however, postal rules prohibit use of the mails. Postal prohibitions apply also to international mailings of lotteries. Though post-office authorities are diligent, it is clear that much smuggling and other violation of interstate and international regulations occurs.

A fourth requirement is a set of rules determining the frequencies and sizes of the prizes. Costs of organizing and promoting the lotteries must be deducted from the pool, and a percentage normally goes as revenues and profits to the state or sponsor. Of the remainder available for the winners, a decision must be made on whether to pay few large prizes or many smaller ones. Potential bettors seem to be attracted to lotteries that offer very large prizes, but in some cultures they also demand a chance to win smaller ones. Authorities on lotteries disagree about which of these choices is better for the welfare of the people and the economic success of the lottery. The amount of the pool returned to the bettors tends to be between 50 percent and 60 percent.

A modern form of lottery ticket sales is the on-line sale, in which tickets are printed by a terminal/printer in a merchant's store. In an online sale where the player chooses numbers, the input/terminal/printer is connected to a secure central computer or lottery computer system operated by the state lottery commission, and it is that central computer system that recognizes and accepts the players' choices of numbers and sends signals to the remote terminal/printer to print the ticket with selected numbers and records the transaction in a secure central database or databank. In a "quick-pick" type of transaction, which is ubiquitous in modern numbers lotteries, the central computer provides the numbers and sends a signal to the remote terminal/printer to print the ticket with those numbers and then records that transaction in the secure central databank.

In multi-state games such as Powerball®, the procedure is basically the same, with each participating state being responsible for verification and winner files, and then reporting to the central coordinating group. In on-line lottery games, a matrix is established that governs the winning combinations and the prize structure. All on-line tickets bear special secure coding to help minimize fraud. On-line lottery tickets have become less popular than instant lottery tickets, due mostly to the fact that instant tickets are much more likely to be purchased on impulse than on-line tickets.

In instant lottery sales, participating merchants receive a number of pre-printed tickets, which are furnished with secure coding minimizing fraud. Like on-line sales, the prizes printed on such tickets are also determined by a matrix that governs winning combinations and the prize structure, based on the prize pay-outs desired, the number of retailers participating and the populations they serve. In order to see the numbers or prizes printed on the tickets and determine if they hold a winning ticket, players scratch off the coating that obscures the printing. Although winning combinations have been printed on some of those instant tickets, no one knows where they are in the package, or even which store received packages containing big winner tickets.

There are also other variations of instant games including punch-board, pull-tab and break-opens. Unlike on-line tickets and scratch-off instant tickets, these variations come in pre-set, pre-determined packages where the matrix has already been built in according to some pre-determined formula suitable for smaller establishments. Unlike scratch-off games, these games have an advantage in that it is a simple matter to add an additional retailer because the addition of that retailer will not affect the matrix because it has been pre-determined, based on the number of tickets comprising the package.

In both online and instant ticket lotteries, prizes that remain unclaimed after some statutorily prescribed period that varies from state to state, ranging up to one year, become void as winning tickets. After the winning tickets become void, any prize money can revert to the state, or be added to future prize pools.

Among the family of modern lottery games are the "passive" or "passive draw" game, the "instant" game, the "pick" game, and the "lotto" game. The "passive draw" game includes a purchase of a pre-numbered ticket. Passive draw tickets are generally sold in ascending numerical order and after a certain period of time a winning number is selected and a prize is awarded to the holder of the ticket bearing the winning number. Another version of a passive game is to add various ways to win. Take an example in which the number selected in a passive drawing is 978571. Holders of tickets matching the first two digits of 97 win prizes, tickets matching the first three digits 978 win prizes, and so forth.

In an "instant" game, a player purchases a preprinted ticket with revealable numbers, symbols, or other game characters. Instant games are usually based on a theme such as card games, lucky numbers, familiar characters, etc. Tickets containing three like symbols win a prize, in which the prize level is preset. If a player's card is a winning card, then the player can immediately (instantly) cash the ticket and receive a prize. There is no traditional drawing to determine a winner in an instant game, and there are literally hundreds of variations of instant games.

In an example of a "pick" game, a player selects a 3 digit number from 000-999. A random number from 000-999 is drawn. If the drawn number matches the number selected by a player, then the player wins a prize. This type of pick game is a "straight bet" game. Another example of a pick game involves a player who selects to play just the first two digits or the last two digits of, for instance, a three digit number. In this case, the prize that may be won is lower but the player only has to match the two digits, in exact order, instead of all three digits. These are called "front and back pair" bets. Yet another variation is called a "box" bet, in which a player selects, for instance, a three digit number but is playing every order of the three digits. For instance, if a player plays the number 123 boxed, then the player really has purchased 6 bets, one each on 123 132, 231, 213, 312, and 321. If any one of these numbers is drawn, the player wins.

A "lotto" game is often referred to as a matrix game, in which a player selects X numbers from a pool of Z numbers. The lottery draws Y numbers from the pool of Z numbers. Players win a prize if enough of their selections match the selections drawn by the lottery. As an example, if the lotto game were a 6-6-36, then the player would select 6 numbers from a pool of 36 and the lottery would draw 6 numbers from the pool of 36 numbers. Players would win if their selections match 3, 4, 5, or 6 of the lottery selections. In this type of game, numbers cannot be duplicated. In other words, every number in a lotto style game is unique, and the order is not relevant in a lotto game.

Many lotteries in the United States and other countries offer games where play is based on the Lottery drawing a three digit number from 000-999. Drawings may be on a daily basis or multiple draws per day or several times per week or per month. The Lottery's selection of the three digit winning number may be from groups of balls or from a random number generator or other selection method. These types of games are commonly referred to as "pick 3" games.

In an example of a pick 3 game, a player selects a three digit number from 000-999. A random number from 000-999 is drawn. If the drawn number matches the number selected by the player, then the player wins a prize. This type of pick 3 game is a "straight bet" game. Another example of a "pick" game involves a player who selects to play just the first two digits or the last two digits of, for instance, a three digit number. In this case, the prize that may be won is lower but the player only has to match the two digits, in exact order, instead of all three digits. These are called "front and back pair" bets. Yet another variation is called a "box" bet, in which a player selects, for instance, a three digit number but is playing every order of the three digits. For instance, if a player plays the number 123 boxed, then the player really has purchased six bets, one each on 123, 132, 231, 213, 312, and 321. If any one of these numbers is drawn, the player wins.

Many Lotteries in the United States and other countries offer games where play is based on the Lottery drawing a 4 digit number from 0000-9999. Drawings may be made on a daily basis or multiple draws per day or several times per week or per month. Selection of the four digit number may be from groups of balls or from a random number generator or other selection method. Similar games may be offered with additional digits, such as 5 digits or 6 digits, with similar methods of play.

In all of the methods of play above for the 3 digit and 4 digit games, the player is restricted to matching all of the digits selected by the lottery regardless of exact or any order. If all of the digits played are not matched, the player does not win. Under the current straight and boxed methods of play, players often match 2 of the 3 numbers but not the $3^{rd}$ and do not win even a secondary prize for coming close. Under the front pair and back pair methods of play, players must match both numbers to win.

Another type of lottery game is the "double matrix" game in which a player selects X numbers from a first pool of numbers and then selects a single number from a second pool of numbers. The lottery then draws or generates X numbers from the first pool of numbers and a single number from the second pool of numbers. Players win by matching some or all of their X numbers drawn from the first pool and the single number drawn from the second pool with some or all of the X numbers generated by the lottery and the single number generated by the lottery, respectively. Typically, lesser prizes are assigned to wins that have a fewer number of matches between the player's numbers and the lottery's numbers or that do not match the number drawn from the second pool, and greater prizes are assigned to wins that have more matches between the player's numbers and the lottery's numbers.

Although the art is replete with various systems and methods for conducting and playing lotteries, needed is yet another that is simple to conduct, uncomplicated, and that provides players with many ways to win.

SUMMARY OF THE INVENTION

According to the principle of the invention, a method includes providing a numerical deviation factor, issuing a chance to win including a group of chance numerals forming a chance number, the group of chance numerals including a first chance numeral, a second chance numeral, and a third chance numeral, and receiving from a drawing a result including a group of result numerals forming a result number, the group of result numerals including a first result numeral, a second result numeral, and a third result numeral. The method next includes comparing the group of chance numerals to the group of result numerals, assigning a first win to the chance if the chance number is the same as the result number, assigning a second win to the chance to win if the first result numeral is one of the same as the first chance numeral, and deviates from the first chance numeral by the numerical deviation factor, assigning a third win to the chance to win if the second result numeral is one of the same as the second chance numeral, and deviates from the second chance numeral by the numerical deviation factor, and assigning a fourth win to the chance to win if the third result numeral is one of the same as the third chance numeral, and deviates from the third chance numeral by the numerical deviation factor. The method further specifies assigning a first prize having a value to the first win, assigning a second prize having a value to the second win, assigning a third prize having a value to the third win, and assigning a fourth prize having a value to the fourth win, wherein the value of the first prize is greater than the value of each of the second, third, and fourth prizes, respectively. In one embodiment, the numerical deviation factor is a factor of at least 1. In another embodiment, the numerical deviation factor is a factor of at least 2.

According to the principle of the invention, a method includes providing a numerical deviation factor, issuing a chance to win consisting of a group of chance numerals including a first chance numeral, a second chance numeral, and a third chance numeral, receiving from a drawing a result consisting of a group of result numerals including a first result numeral, a second result numeral, and a third result numeral, comparing the group of chance numerals to the group of result numerals, assigning a first win to the chance to win if the first result numeral is one of the same as the first chance numeral, and deviates from the first chance numeral by the numerical deviation factor, assigning a second win to the chance to win if the second result numeral is one of the same as the second chance numeral, and deviates from the second chance numeral by the numerical deviation factor, and assigning a third win to the chance to win if the third result numeral is one of the same as the third chance numeral, and deviates from the third chance numeral by the numerical deviation factor. The method further provides assigning a first prize having a value to the first win, assigning a second prize having a value to the second win, and assigning a third prize having a value to the third win. The method also includes assigning a fourth win to the chance to win if the first, second, and third result numerals match the first, second, and third chance numerals, respectively. The method still further provides assigning a fourth prize having a value to the fourth win, in which the value of the fourth prize is greater that the value of each of the first prize, the second prize, and the third prize. In one embodiment, the numerical deviation factor is a factor of at least 1. In another embodiment, the numerical deviation factor is a factor of at least 2.

According to the principle of the invention, a method of conducting and playing a lottery game includes providing a numerical deviation factor, and issuing a chance to win to a player comprising a lottery ticket imprinted with groups of chance numerals, the groups of chance numerals comprising a group of primary numerals, and groups of option numerals, the lottery ticket being made available to the player. The primary numerals of the group of primary numerals and the option numerals of each of the groups of option numerals being equal in number, and each option numeral of each group of option numerals being one of a) the same as a positionally corresponding one of the primary numerals of the group of primary numerals, and b) different from the positionally corresponding one of the primary numerals of the group of primary numerals by the numerical deviation factor. The method next includes receiving from a drawing a result comprising a group of result numerals. The result numerals of the group of result numerals are equal in number to the primary numerals of the group of primary numerals, and are equal in number to the option numerals of each of the groups of option numerals. The result numerals of the group of result numbers positionally correspond to the primary numerals of the group of primary numerals, and positionally correspond to the option numerals of each of the groups of option numerals. The method further includes comparing the group of result numerals to the groups of chance numerals, and assigning a win to the chance to win if the group of result numerals is the same one of the groups of chance numerals. After assigning a win, the method next provides assigning a first prize having a first value to the chance to win if the group of result numerals is the same as the group of primary numerals, and assigning a second prize having a second value lesser than the first value of the first prize to the chance to win if the group of result numerals is the same as one of the groups of option numerals. The primary numerals of the group of primary numerals, the option numerals of the groups of option numerals, and the result numerals of the group of result numerals are selected from a group of numbers consisting of 0, 1, 2, 3, 4, 5, 6, 7, 8, and 9. The numerical deviation factor is the number 1 in a preferred embodiment, is the number 2 in an alternate embodiment, or other number. The primary numerals of the group of primary numerals, the option numerals of each of the groups of option numerals, and the result numerals of the group of result numerals are each three in number in a preferred embodiment.

According to the principle of the invention, a method of conducting and playing a lottery game, comprising steps of providing a lottery computer system programmed with a numerical deviation factor, inputting into the lottery computer system group of primary numerals and, in response thereto, the computer system calculating groups of option numbers extrapolated from the group of primary numerals and the numerical deviation factor, and issuing to the player a chance to win comprising a lottery ticket imprinted with groups of chance numerals, wherein the groups of chance numerals the group of primary numerals, and the groups of option numerals. The primary numerals of the group of primary numerals and the option numerals of each of the groups of option numerals being equal in number, and each option numeral of each group of option numerals being one of a) the same as a positionally corresponding one of the primary numerals of the group of primary numerals, and b)

different from the positionally corresponding one of the primary numerals of the group of primary numerals by the numerical deviation factor. The method next includes receiving from a drawing a result comprising a group of result numerals, the result numerals of the group of result numerals being equal in number to the primary numerals of the group of primary numerals, and being equal in number to the option numerals of each of the groups of option numerals, and the result numerals of the group of result numbers positionally corresponding to the primary numerals of the group of primary numerals, and positionally corresponding to the option numerals of each of the groups of option numerals. The method still further includes comparing the group of result numerals to the groups of chance numerals, and assigning a win to the chance to win if the group of result numerals is the same one of the groups of chance numerals. The method further includes comparing the group of result numerals to the groups of chance numerals, and assigning a win to the chance to win if the group of result numerals is the same one of the groups of chance numerals. After assigning a win, the method next provides assigning a first prize having a first value to the chance to win if the group of result numerals is the same as the group of primary numerals, and assigning a second prize having a second value lesser than the first value of the first prize to the chance to win if the group of result numerals is the same as one of the groups of option numerals. The primary numerals of the group of primary numerals, the option numerals of the groups of option numerals, and the result numerals of the group of result numerals are selected from a group of numbers consisting of 0, 1, 2, 3, 4, 5, 6, 7, 8, and 9. The numerical deviation factor is the number 1 in a preferred embodiment, is the number 2 in an alternate embodiment, or other number. The primary numerals of the group of primary numerals, the option numerals of each of the groups of option numerals, and the result numerals of the group of result numerals are each three in number in a preferred embodiment.

BRIEF DESCRIPTION OF THE DRAWINGS

Referring to the drawings:

FIG. 1 illustrates a lottery ticket of a lottery drawing, the lottery ticket being constructed and arranged in accordance with the principle of the invention and imprinted with groups of chance numerals, including a group of primary numerals and groups of option numerals each representing a chance to win.

DETAILED DESCRIPTION

Methods of conducting and playing a lottery game are disclosed. In accordance with the principle of the invention, a preferred method includes first providing a numerical deviation factor, and issuing a chance to win to a player. These actions are typically carried out by the Lottery or the administrator of the lottery game. The chance to win consists of a group of chance or primary numerals. The chance or primary numerals preferably form a chance number and, more specifically, a chance primary number. The group of chance numerals including three chance numerals, which include a first chance numeral, a second chance numeral, and a third chance numeral. Each of the first, second, and third chance numerals are selected from a pool of chance numerals consisting of numerals 0-9, in which 0 is considered to be a numeral according to the teachings of the present invention. The chance numerals are whole numerals, namely, nonnegative integers 0-9. As will be discussed later in this specification, the numerical deviation factor is a whole numeral, namely, a nonnegative integer selected from the group 1-9. The term "numeral" used throughout this specification means a nonnegative integer, namely, nonnegative integers 0-9 as applied to chance numerals and result numerals, which are discussed later in this specification, and nonnegative integers 1-9 as applied to the numerical deviation factors.

As with all of the embodiments set forth in this disclosure, the group of chance/primary numerals, namely, the first, second, and third chance numerals, are issued by way of a drawing. As a way of drawing the chance numerals forming the group of chance/primary numerals, a player or the Lottery or the administrator of the lottery game chooses or selects the chance numerals each from a pool of chance numerals consisting of pool 0-9. As way of drawing the chance numerals in a chance to win, a player can be issued the chance numerals selected from a random draw of chance numerals, if desired, each from the pool 0-9 of chance numerals.

The chance to win is preferably presented on a lottery ticket issued to a player in any manner in which chances to win are issued to players in a lottery in which there is to be drawing for the purpose of determining a winner or winners. For instance, in one embodiment the chance to win is issued to a player over a networked computer environment, such as a local area network, a global computer network, etc. In another embodiment, the chance to win is issued to a player with a conventional lottery ticket dispensing system. A player can be required to make a purchase of a consumer item and/or purchase a lottery ticket in order to enter into the lottery game of the invention, although the chance to win can be issued to players without the need for the player to purchase them or to make a purchase of a consumer item.

After a chance to win is issued to a player, and typically after chances to win are issued to numerous players if desired, a random drawing is conducted, such as in a straight drawing procedure or other form of random drawing procedure, in which there is a step of receiving from the drawing a result including a group of result numerals forming a result number. The group of result numerals preferably including three result numerals, which is equal to the number of chance numerals issued in the chance to win. The group of result numerals includes a first result numeral, a second result numeral, and a third result numeral. The chance numerals positionally correspond with respect to the result numerals, in which the first result numeral corresponds to the first chance numeral, the second result numeral corresponds to the second chance numeral, and the third result numeral corresponds to the third chance numeral. This is positional matching. Each of the first, second, and third result numerals are selected from a pool of result numerals consisting of numerals 0-9, in which 0, as discussed above, is considered to be a numeral according to the teachings of the present invention. The result numerals are whole numerals, namely, nonnegative integers 0-9. The random drawing for the result can, if desired, be conducted before the chance to win is issued to a player.

After the result is obtained from the drawing, the method next includes comparing the group of chance numerals to the group of result numerals (it is envisioned that the player will compare his chance to win with the result), assigning a first win to the chance to win if the chance number is the same as the result number, assigning a second win to the chance to win if the first result numeral is one of the same as the first chance numeral and deviates from the first chance numeral by the numerical deviation factor, assigning a third win to the chance to win if the second result numeral is one of the same as the second chance numeral and deviates from the second chance numeral by the numerical deviation factor, and assigning a fourth win to the chance to win if the third result numeral is one of the same as the third chance numeral and deviates from the third chance numeral by the numerical deviation factor. The method further specifies assigning a first prize having a value to the first win, assigning a second prize having a value to the second win, assigning a third prize having a value to the third win, and assigning a fourth prize having a value to the fourth win, wherein the value of the first prize is greater than the value of each of the second, third, and fourth prizes, respectively.

In a particular embodiment, the numerical deviation factor is the numeral 1. According to the principle of the invention, an example of a chance to win and a result obtained from a drawing in a lottery game assigned a numerical deviation factor of 1 is set forth below in Example A:

Example A

| | Position 1 | Position 2 | Position 3 |
|---|---|---|---|
| Chance | 3 | 4 | 5 |
| Result | 2 | 2 | 7 |

In Example A, there is a chance consisting of three chance numerals, and there is a result consisting of three positionally matching or positionally corresponding result numerals. The chance numerals include first chance numeral 3 at Position 1, second chance numeral 4 at Position 2, and third chance numeral 5 at Position 3, in which these chance numerals form chance number 345 according to the invention. The result numerals include first result numeral 2 at Position 1, second result numeral 2 at Position 2, and third result numeral 7 at Position 3, in which these result numerals form result number 227.

In Example A, the chance or primary number is 345 and the result number is 227. Clearly, the chance number is not the same as the result number and there is no assigned win based on the chance number matching the result number. However, the first chance numeral at Position 1, while it does not match the first result numeral at Position 1, deviates from the first result numeral at Position 1 by a numerical deviation factor of 1. Because the assigned numerical deviation factor in Example A is 1 and because the first chance numeral at Position 1 deviates from the first result numeral at Position 1 by a numerical deviation factor of 1, there is a win at Position 1 between the chance and the result and a win is therefore assigned between the chance and the result, in accordance with the principle of the invention. In other words, because the assigned numerical deviation factor in Example A is 1 and because the first chance numeral at Position 1 deviates from the first result numeral at Position 1 by a numerical deviation factor of 1, the chance is a winner at Position 1. Because the chance is a winner at Position 1 in Example A, the method further specifies assigning a prize having a value to this win.

The second chance numeral at Position 2 is 4 and the second result numeral at Position 2 is 2, and the third chance numeral at Position 3 is 5 and the third result numeral at Position 3 is 7. As a result, the numerical deviation between the chance and result numerals at each of Positions 2 and 3 is 2, which is greater than the numerical deviation factor of 1 in Example A. As a result, there is no win between the chance and result at Position 2 in Example A, and there is no win between the chance and the result at Position 3 in Example A.

According to the principle of the invention, there are many different results that may be obtained to form a win for the chance in Example A. For instance, the chance in Example A is a winner if the result numeral at Position 1 is a 3 (an exact match), a 2 (one number lower than 3 which is a number that deviates from the chance numeral at Position 1 by the numerical deviation factor of 1 assigned to Example A), or a 4 (one number higher than 3 which is a number that deviates from the chance numeral at Position 1 by the numerical deviation factor of 1 assigned to Example A). The chance in Example A is also a winner if the result numeral at Position 2 is a 4 (an exact match), a 3 (one number lower than 4 which is a number that deviates from the chance numeral at Position 2 by the numerical deviation factor of 1 assigned to Example A), or a 5 (one number higher than 4 which is a number that deviates from the chance numeral at Position 2 by the numerical deviation factor of 1 assigned to Example A). The chance in Example A is still further a winner if the result numeral at Position 3 is a 5 (an exact match), a 4 (one number lower than 5 which is a number that deviates from the chance numeral at Position 3 by the numerical deviation factor of 1 assigned to Example A), or a 6 (one number higher than 5 which is a number that deviates from the chance numeral at Position 3 by the numerical deviation factor of 1 assigned to Example A). And so in Example A the chance is a winner if the result is 345, which is an exact match of the group of chance/primary numerals. The chance is also a winner of the result is one of 254, 435, 356, 335, 245, 445, 255, 236, 256, 444, 354, 235, 244, 246, 455, 454, 434, 446, 336, 344, 346, 355, 334, and 234, which are considered groups of chance numerals, namely, groups of option or secondary numerals each being an option or secondary number representing a form of a chance numeral and a win if matched by the result. This large number of winning result combinations, namely, groups of option or secondary numerals, makes it relatively easy for a player to win thereby motivating the player to play the lottery game, in accordance with the principle of the invention.

And so primary and option/secondary numbers are each considered a chance number that could represent a win if the chance numerals thereof match the result numerals of a result number. As explained above, the chance to win is preferably presented on a lottery ticket, and an example of such a lottery ticket is illustrated and denoted at 10 in FIG. 1. Lottery ticket 10 in FIG. 1 is arranged to correspond to the chance of Example A. In FIG. 1, lottery ticket 10 is imprinted with chance numbers being groups of chance numerals, including a group of primary numerals forming chance number 345 according to the chance of Example A, and also groups of the option or secondary numerals forming option or secondary numbers 254, 435, 356, 335, 245, 445, 255, 236, 256, 444, 354, 235, 244, 246, 455, 454, 434, 446, 336, 344, 346, 355, 334, and 234, that each represent a win if matched by the result. In lottery ticket 10, the chance to win consisting of the group of primary numerals forming chance number 235 and the groups of option or secondary numerals forming option or secondary numbers 254, 435, 356, 335, 245, 445, 255, 236, 256, 444, 354, 235, 244, 246, 455, 454, 434, 446, 336, 344, 346, 355, 334, and 234, are imprinted on ticket 10 to provide a player with each of the possible wins of ticket 10, which allows the user to easily compare the result to chance number 235 and to option or secondary numbers 254, 435, 356, 335, 245, 445, 255, 236, 256, 444, 354, 235, 244, 246, 455, 454, 434, 446, 336, 344, 346, 355, 334, and 234 to discover whether ticket 10 is a winning ticket according to the principle of the invention, namely, a ticket having a chance number having chance numerals that positionally match the result numerals of a result number.

In lottery ticket 10, the chance/primary and option/secondary numbers, which are chance numbers, are clearly imprinted on ticket 10 so as to be easily seen. Again, the choice or selection of the primary chance number is made by a player or is made automatically by the Lottery or administrator of the lottery game. As with a conventional lottery, the lottery tickets are issued through a lottery game computer system denoted at 20 in FIG. 1, which is a conventional lottery game computer system. Where a player selects the primary number, the primary number is entered into computer system 20 from an input 21, such as a register, terminal, workstation, or the like. Where a player elects to have the primary number chosen or selected for him, a corresponding entry is made from an input, such as input 21, commanding computer system 20 to randomly choose or select the primary number. The numerical deviation factor is previously entered or programmed into computer system 20. Once the primary number is chosen or selected at input 21, whether randomly chosen or deliberately chosen by the player, and which in this example is primary number 345, computer system 20 is responsive and based on the numerical deviation factor, which in this instance is numerical deviation factor 1, calculates through the initiation of a simple software algorithm the option or secondary numbers 254, 435, 356, 335, 245, 445, 255, 236, 256, 444, 354, 235, 244, 246, 455, 454, 434, 446, 336, 344, 346, 355, 334, and 234 extrapolated from the numerical deviation factor and from the chosen or selected primary number 345, and then issues lottery ticket 10 to the player through input 21 imprinted with and bearing not only primary number 345, but also option or secondary numbers 254, 435, 356, 335, 245, 445, 255, 236, 256, 444, 354, 235, 244, 246, 455, 454, 434, 446, 336, 344, 346, 355, 334, and 234, according to the principle of the invention. Lottery ticket 10 is preferably a printed document and is a legal document, as is the case with conventional lottery tickets. With lottery ticket 10 imprinted with the primary number and the option or secondary numbers as shown and described in conjunction with lottery ticket 10, lottery ticket 10 is presented and made available to the player of the lottery game at input 21 for use to that player in the form of a display/printed document as shown in FIG. 1, which the player may use to determine whether any of the chance numbers printed on lottery ticket 10 represent a win based on a comparison of the chance numbers to a result consisting of a result number obtained from a drawing. Preferably, input 21 is formed with or otherwise associated with a printer or other output that prints and presents lottery ticket 10 to the player.

The use of computer system 20 and input 21 is exemplary of an on-line lottery ticket sale or issuance, in which lottery tickets are printed by a terminal/printer of input 21, such as at a merchant's store. In an online sale where the player chooses numbers, input 21 is connected to computer system 20, which recognizes and accepts chosen players' choices of primary numbers or chooses/selects primary numbers for players in automatic or random selections for players, and sends signals to input 21 to print the ticket, namely, lottery ticket 10, with the chance numbers as explained above.

And so in the present embodiment, the primary number is 345, which, as explained above, is chosen/selected by a player or, in the alternative, chosen/selected by the Lottery or lottery game administrator, namely, by lottery computer system 20. Computer system 20 is programmed with the numerical deviation factor, and based on the numerical deviation factor and the chosen selected primary number input to computer system 20 from input 21, computer system 20 is responsive and calculates the option/secondary numbers and then issues lottery ticket 10 at input 21 imprinted with the primary number and the option/secondary numbers, each representing a chance numeral and, accordingly, a chance to win. In FIG. 1, as a matter of example, the chose/selected primary number is 345 and the numerical deviation factor is 1, primary number 345 is imprinted within a first field 12A on ticket 10, and the option/secondary numbers are imprinted within a second field 12B on ticket 10. Because there is only one primary number and numerous option/secondary numbers, field 12A encompassing primary number 345 is considerably smaller than field 12B encompassing option/secondary numbers 254, 435, 356, 335, 245, 445, 255, 236, 256, 444, 354, 235, 244, 246, 455, 454, 434, 446, 336, 344, 346, 355, 334, and 234. Because in Example A the numerical deviation factor is 1, lottery ticket 10 is preferably imprinted to denote the numerical deviation factor as 1, which, as a matter of example, is imprinted at the bottom of lottery ticket 10 at 14.

In connection with lottery ticket 10, a method of conducting and playing a lottery game includes providing a numerical deviation factor, and issuing a chance to win comprising lottery ticket 10 imprinted with groups of chance numerals, the groups of chance numerals including a group of primary numerals, namely, primary number 345, and groups of option/secondary numerals, namely, option/secondary numbers 254, 435, 356, 335, 245, 445, 255, 236, 256, 444, 354, 235, 244, 246, 455, 454, 434, 446, 336, 344, 346, 355, 334, and 234. The primary numerals of the primary number and the option/secondary numerals of each option/primary numbers are equal in number, that number being three in the present embodiment, and each option/secondary numeral of each group of option/secondary numerals is one of a) the same as a positionally corresponding one of the primary numerals of the group of primary numerals, and b) different from the positionally corresponding one of the primary numerals of the group of primary numerals by the numerical deviation factor. At this stage of a method incorporating lottery ticket 10, which is explained above in detail in connection with Example A, the method next includes receiving from a drawing a result comprising a group of result numerals. The result numerals of the group of result numerals are equal in number to the primary numerals of the group of primary numerals, and are equal in number to the option/secondary numerals of each of the groups of option/secondary numerals. The result numerals of the group of result numbers positionally correspond to the primary numerals of the group of primary numerals, and positionally correspond to the option/secondary numerals of each of the groups of option/secondary numerals. The method further includes comparing the group of result numerals to the groups of chance numerals, and assigning a win to the chance to win, and thus to the lottery ticket, if the group of result numerals is the same as one of the groups of chance numerals.

The win representing the prize having the highest value occurs when the chance number consisting of the primary number is the same as the result number. All other wins corresponding to the option numbers have values that are lesser than the value assigned to the win that occurs when the primary number of the chance numbers matches the result number, and can have the same value lesser than the highest value prize or different values each lesser than the highest value prize. The value of the wins can vary depending on bet amounts. Pay amounts may be determined based on a percentage of play or by pari-mutual calculations. A high value prize may be awarded to a chance to win when the chance numerals match one, two or three result numerals of the result exactly, and a prize having a lesser value when one or more of the result numerals deviate from the respective chance numerals by the assigned numerical deviation factor. Further, prizes of varying value may be awarded on combinations of matching one or more numerals exactly with the remaining one or two numerals plus or minus the assigned numerical deviation factor. The prizes are preferably monetary prizes, but they can be consumer goods, tickets to entertainment events, etc.

And so in the present example, a method of playing a lottery that includes issuing a chance to win where a primary number from 000 to 999 is selected. The player is issued a lottery ticket in which the number chosen, namely, the primary number, is printed along with the secondary combinations of option or secondary numbers where the first digit of each combination is either the same as the first digit of the primary number or one digit higher or lower than the first digit of the primary number by the numerical deviation factor, and the second digit of each combination is either the same as the second digit of the primary number or higher or lower than the second digit of the primary number by the numerical deviation factor, and the third digit of each combination is either the same as the third digit of the primary number or higher or lower than the third digit of the primary number by the numerical deviation factor. And then as above, the method next includes receiving from a drawing a result comprising a result number from 000 to 999, comparing the result number to primary number and to the option or secondary numbers, and assigning a win to the chance to win if the result number is the same one of the primary number and the option/secondary numbers. Because in the present embodiment the primary and result numbers are selected from 000 to 999, this embodiment is exemplary of a three-pick system. In alternate embodiments, the primary and result numbers are selected from 00 to 99 in a two-pick system, the primary and result numbers are selected from 0000 to 9999 in a four-pick system, the primary and result numbers are selected from 00000 to 99999 in a five-pick system, the primary and result numbers are selected from 000000 to 999999 in a six-pick system, and so on.

In an alternate embodiment of the invention, the numerical deviation factor is the numeral 2. According to the principle of the invention, an example of a chance to win and a result obtained from a drawing in a lottery game assigned a numerical deviation factor of 2 is set forth below in Example B:

Example B

| | Position 1 | Position 2 | Position 3 |
|---|---|---|---|
| Chance | 3 | 4 | 5 |
| Result | 5 | 1 | 8 |

In Example B, there is a chance consisting of three chance numerals, and there is a result consisting of three result numerals. The chance numerals include first chance numeral 3 at Position 1, second chance numeral 4 at Position 2, and third chance numeral 5 at Position 3, in which these chance numerals form chance number 345 according to the invention. The result numerals include first result numeral 5 at Position 1, second result numeral 1 at Position 2, and third result numeral 8 at Position 3, in which these result numerals form result number 518.

In Example B, the chance number is 345 and the result number is 518. Clearly, the chance number is not the same as the result number and there is no assigned win based on the chance number matching the result number. However, the first chance numeral at Position 1, while it does not match the first result numeral at Position 1, deviates from the first result numeral at Position 1 by a numerical deviation factor of 2. Because the assigned numerical deviation factor in Example B is 2 and because the first chance numeral at Position 1 deviates from the first result numeral at Position 1 by a numerical deviation factor of 2, there is a win at Position 1 between the chance and the result and a win is therefore assigned between the chance and the result, in accordance with the principle of the invention. In other words, because the assigned numerical deviation factor in Example B is 2 and because the first chance numeral at Position 1 deviates from the first result numeral at Position 1 by a numerical deviation factor of 2, the chance is a winner at Position 1. Because the chance is a winner at Position 1 in Example B, the method further specifies assigning a prize having a value to this win.

The second chance numeral at Position 2 is 4 and the second result numeral at Position 2 is 1, and the third chance numeral at Position 3 is 5 and the third result numeral at Position 3 is 8. As a result, the numerical deviation between the chance and result numerals at each of Positions 2 and 3 is 3, which is greater than the numerical deviation factor of 2 in Example B. As a result, there is no win between the chance and result at Position 2 in Example B, and there is no win between the chance and the result at Position 3 in Example B.

According to the principle of the invention, there are many different results that may be obtained to form a win for the chance in Example B. For instance, the chance in Example B is a winner if the result numeral at Position 1 is a 3 (an exact match), a 1 (two numbers lower than 3 which is a number that deviates from the chance numeral at Position 1 by the numerical deviation factor of 2 assigned to Example B), or a 5 (two numbers higher than 3 which is a number that deviates from the chance numeral at Position 1 by the numerical deviation factor of 2 assigned to Example B). The chance in Example B is also a winner if the result numeral at Position 2 is a 4 (an exact match), a 2 (two numbers lower than 4 which is a number that deviates from the chance numeral at Position 2 by the numerical deviation factor of 2 assigned to Example B), or a 6 (two numbers higher than 4 which is a number that deviates from the chance numeral at Position 2 by the numerical deviation factor of 2 assigned to Example B). The chance in Example B is still further a winner if the result numeral at Position 3 is a 5 (an exact match), a 3 (two numbers lower than 5 which is a number that deviates from the chance numeral at Position 3 by the numerical deviation factor of 2 assigned to Example B), or a 7 (two numbers higher than 5 which is a number that deviates from the chance numeral at Position 3 by the numerical deviation factor of 2 assigned to Example B). And so in Example B, like Example A, there are a wide array of results that will produce a win. The discussion of the prizes in connection with Example A applies equally to Example B.

In yet a further embodiment of the invention, the numerical deviation factor is the numeral 2 and any and all numerals lower than 2, which, in this example, includes the numerical deviation factor 1. According to the principle of the invention, an example of a chance to win and a result obtained from a drawing in a lottery game assigned a numerical deviation factor of 2 and any and all numerals lower than 2, or otherwise between 2 and 0, is set forth below in Example C:

| Example C | | | |
|---|---|---|---|
| | Position 1 | Position 2 | Position 3 |
| Chance | 3 | 4 | 5 |
| Result | 4 | 2 | 8 |

In Example C, there is a chance consisting of three chance numerals, and there is a result consisting of three result numerals. The chance numerals include first chance numeral 3 at Position 1, second chance numeral 4 at Position 2, and third chance numeral 5 at Position 3, in which these chance numerals form chance number 345 according to the invention. The result numerals include first result numeral 4 at Position 1, second result numeral 2 at Position 2, and third result numeral 8 at Position 3, in which these result numerals form result number 428.

In Example C, the chance number is 345 and the result number is 428. Clearly, the chance number is not the same as the result number and there is no assigned win based on the chance number matching the result number. However, the first chance numeral at Position 1, while it does not match the first result numeral at Position 1, deviates from the first result numeral at Position 1 by a numerical deviation factor of 1. Because the assigned numerical deviation factor in Example C is 2 and any and all numerals lower than 2 and because the first chance numeral at Position 1 deviates from the first result numeral at Position 1 by a numerical deviation factor of 1 which is lower than numerical deviation factor of 2, there is a win at Position 1 between the chance and the result and a win is therefore assigned between the chance and the result, in accordance with the principle of the invention. In other words, because the assigned numerical deviation factor in Example C is 2 and any and all numerals below 2 and because the first chance numeral at Position 1 deviates from the first result numeral at Position 1 by a numerical deviation factor of 1, the chance is a winner at Position 1. Because the chance is a winner at Position 1 in Example C, the method further specifies assigning a prize having a value to this win.

In Example C, the second chance numeral at Position 2, while it does not match the second result numeral at Position 2, deviates from the second result numeral at Position 2 by a numerical deviation factor of 2. Because the assigned numerical deviation factor in Example C is 2 and any and all numerals lower than 2 and because the second chance numeral at Position 2 deviates from the second result numeral at Position 2 by a numerical deviation factor of 2, there is a win at Position 2 between the chance and the result and a win is therefore assigned between the chance and the result, in accordance with the principle of the invention. In other words, because the assigned numerical deviation factor in Example C is 2 and any and all numerals below 2 and because the second chance numeral at Position 2 deviates from the second result numeral at Position 2 by a numerical deviation factor of 2, the chance is a winner at Position 2. Because the chance is a winner at Position 2 in Example C, the method further specifies assigning a prize having a value to this win.

The third chance numeral at Position 3 in Example C is 5 and the third result numeral at Position 3 in Example C is 8. As a result, the numerical deviation between the chance and result numerals at Position 3 is 3, which is greater than the numerical deviation factor of 2 in Example C. As a result, there is no win between the chance and result at Position 3 in Example C, and there is no win between the chance and the result at Position 3 in Example C.

According to the principle of the invention, there are many different results that may be obtained to form a win for the chance in Example C. For instance, the chance in Example C is a winner if the result numeral at Position 1 is a 3 (an exact match), a 1 (two numbers lower than 3 which is a number that deviates from the chance numeral at Position 1 by the numerical deviation factor of 2 assigned to Example C), 5 (two numbers higher than 3 which is a number that deviates from the chance numeral at Position 1 by the numerical deviation factor of 2 assigned to Example C), 2 (one number lower than 3 which is a number that deviates from the chance numeral at Position 1 by the numerical deviation factor of 1 that is lower than the assigned numerical deviation factor of 2 assigned to Example C), or 4 (one number higher than 3 which is a number that deviates from the chance numeral at Position 1 by the numerical deviation factor of 1 that is lower than the assigned numerical deviation factor of 2 assigned to Example C). The chance in Example C is also a winner if the result numeral at Position 2 is a 4 (an exact match), a 2 (two numbers lower than 4 which is a number that deviates from the chance numeral at Position 2 by the numerical deviation factor of 2 assigned to Example C), 6 (two numbers higher than 4 which is a number that deviates from the chance numeral at Position 2 by the numerical deviation factor of 2 assigned to Example C), 3 (one number lower than 4 which is a number that deviates from the chance numeral at Position 2 by the numerical deviation factor of 1 that is lower than the assigned numerical deviation factor of 2 assigned to Example C), or 5 (one number higher than 4 which is a number that deviates from the chance numeral at Position 2 by the numerical deviation factor of 1 that is lower than the assigned numerical deviation factor of 2 assigned to Example C). The chance in Example C is still further a winner if the result numeral at Position 3 is a 5 (an exact match), a 3 (two numbers lower than 5 which is a number that deviates from the chance numeral at Position 3 by the numerical deviation factor of 2 assigned to Example C), a 7 (two numbers higher than 5 which is a number that deviates from the chance numeral at Position 3 by the numerical deviation factor of 2 assigned to Example C), 4 (one number lower than 5 which is a number that deviates from the chance numeral at Position 3 by the numerical deviation factor of 1 that is lower than the assigned numerical deviation factor of 2 assigned to Example C), or 6 (one number higher than 5 which is a number that deviates from the chance numeral at Position 3 by the numerical deviation factor of 1 that is lower than the assigned numerical deviation factor of 2 assigned to Example C). And so in Example C, like Examples A and B, there are a wide array of results that will produce a win. The discussion of the prizes in connection with Example A applies equally to Example C.

Example C is an example of a chance to win and a result obtained from a drawing in a lottery game assigned a numerical deviation factor of 2 and any and all numerals lower than 2, or otherwise between 2 and 0, which, in this example, is 1. Another example can be a chance to win and a result obtained from a drawing in a lottery game assigned a numerical deviation factor of 3 and any and all numerals lower than 3, or otherwise between 3 and 0, which, in this embodiment, would be 2 and 1. Yet another example can be a chance to win and a result obtained from a drawing in a lottery game assigned a numerical deviation factor of 4 and any and all numerals lower than 4, or otherwise between 4 and 0, which, in this embodiment, would be 3, 2, and 1. Accordingly, a lottery game according to the invention may be assigned a numerical deviation factor with however many numerical deviation factors that fall between the assigned numerical deviation factor and 0.

It is to be understood that in the embodiments incorporating a numerical deviation factor, that the result numerals "circulate" about the 0-9 integers moving up from 0 to 9, and down from 9 to 0. For example, in a case where a chance numeral is 1 and the numerical deviation factor is 2, result numerals 9 and 3 are each matching corresponding result numerals because they each deviate from the chance numeral 1 by a factor of two. In another example as a matter of illustration, in a case where a chance numeral is 9 and the numerical deviation factor is 1, result numerals 8 and 0 are each matching corresponding result numerals because they each deviate from the chance numeral 1 by a factor of 1. In yet another example as a matter of illustration, in a case where a chance numeral is 0 and the numerical deviation factor is 2, result numerals 2 and 8 are each matching corresponding result numerals because they each deviate from the chance numeral 0 by a factor of 2.

FIG. 1 illustrates lottery ticket 10 arranged in accordance with Example A. A lottery ticket may be similarly provided in connection with the alternate examples described above in Examples B and C, and further alternate embodiments of the invention constructed and arranged in accordance with this disclosure. Furthermore, in the examples above, the primary numerals of the group of primary numerals, the option numerals of each of the groups of option numerals, and the result numerals of the group of result numerals are each equal in number and are each three in number in the preferred embodiments and may each be four in number in an alternate embodiment, two in number in yet an further embodiment, five in number in yet still a further embodiment, six in number in yet still yet a further embodiment, or other number.

The examples presented in this specification incorporate chances to win having three chance numerals and three corresponding result numerals, and other numbers of chance numerals and corresponding result numerals, whether greater or lesser in number, can be utilized in alternate lottery game embodiments without departing from the invention. In this respect, lottery games utilizing the invention disclosed herein can include groups of chance and result numerals each consisting of 2 numerals, 4 numerals, 5 numerals, etc. Moreover, although each embodiment disclosed herein relates to a chance to win consisting of one group of chance numerals forming a chance number, a chance to win can include multiple different groups of chance numerals representing chance numerals, respectively. Furthermore, each position of each chance numeral and of each result number is occupied by a single-digit number from 0-9. In an alternate embodiment, one or more of each position of each chance numeral and of each result number can be occupied by a multi-digit number. These alternate features of the invention constitute alternate embodiments of the invention.

In the lottery game embodiments discussed in Examples A, B, and C, a win applies when a chance number, whether a primary number or an option/secondary number, matches a result number. If desired, wins in a lottery game carried out in accordance with the invention can relate only to matching positionally corresponding chance and result numerals, or to positionally corresponding chance and result numerals that deviate within a designated numerical deviation factor. In another aspect, wins in a lottery game carried out in accordance with the invention can also relate to matching chance and result numerals, or to chance and result numerals that deviate within a designated numerical deviation factor, regardless of the positions of the chance and result numerals, in accordance with the principle of the invention. These alternate features of the invention constitute alternate embodiments of the invention.

The present invention is described above with reference to preferred embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A method of conducting and playing a lottery game, the method comprising the steps of:

providing a lottery computer system, the lottery computer system being pre-programmed before a drawing with a numerical deviation factor;

creating different chances to win for a lottery ticket for a player before the drawing and before issuing the lottery ticket to the player including the steps of inputting into the lottery computer system a group of primary numerals and the computer system calculating groups of option numerals extrapolated from the group of primary numerals and the numerical deviation factor in response, the group of primary numerals and the groups of option numerals being groups of chance numerals for the lottery ticket;

the computer system issuing to the player the lottery ticket imprinted with all of the groups of chance numerals;

the primary numerals of the group of primary numerals and the option numerals of each of the groups of option numerals are equal in number and are arranged in corresponding positions, and each option numeral of each group of option numerals being one of a) the same as a positionally corresponding one of the primary numerals of the group of primary numerals, and b) different from the positionally corresponding one of the primary numerals of the group of primary numerals by the numerical deviation factor, wherein the groups of chance numerals imprinted on the lottery ticket are different from one another and define the different chances to win of the lottery ticket;

receiving from the drawing a result being a group of result numerals;

the result numerals of the group of result numerals being equal in number to the primary numerals of the group of primary numerals, and being equal in number to the option numerals of each of the groups of option numerals;

the result numerals of the group of result numbers positionally corresponding to the primary numerals of the group of primary numerals, and positionally corresponding to the option numerals of each of the groups of option numerals;

comparing the group of result numerals to the groups of chance numerals, wherein the ticket is a winning ticket if the group of result numerals is the same as one of the groups of chance numerals;

the groups of chance numerals imprinted on the lottery ticket enable the player to compare the group of result numbers to each of the groups of chance numerals imprinted on the lottery ticket for enabling the player to determine whether any of the groups of chance numerals imprinted on the lottery ticket is the same as the group of result numerals.

2. The method of conducting and playing a lottery game according to claim 1, further comprising:

assigning a first prize having a first value to the lottery ticket if the group of result numerals is the same as the group of primary numerals; and assigning a second prize having a second value lesser than the first value of the first prize to the lottery ticket if the group of result numerals is the same as one of the groups of option numerals.

3. The method of conducting and playing a lottery game according to claim 2, wherein the primary numerals of the group of primary numerals, the option numerals of the groups of option numerals, and the result numerals of the group of result numerals are selected from a group of numbers consisting of 0, 1, 2, 3, 4, 5, 6, 7, 8, and 9.

4. The method of conducting and playing a lottery game according to claim 3, wherein the numerical deviation factor is the number 1.

5. The method of conducting and playing a lottery game according to claim 3, wherein the numerical deviation factor is the number 2.

6. The method of conducting and playing a lottery game according to claim 3, wherein the primary numerals of the group of primary numerals, the option numerals of each of the groups of option numerals, and the result numerals of the group of result numerals are each at least three in number.

7. A method of issuing a lottery ticket in advance of a lottery drawing in the playing of a lottery game, the method comprising the steps of:

providing a lottery computer system, the lottery computer system being pre-programmed before a drawing with a numerical deviation factor;

creating different chances to win for a lottery ticket for a player before the drawing and before issuing the lottery ticket to the player including the steps of inputting into the lottery computer system a group of primary numerals and the computer system calculating groups of option numerals extrapolated from the group of primary numerals and the numerical deviation factor in response, the group of primary numerals and the groups of option numerals being groups of chance numerals for the lottery ticket;

the computer system issuing to the player the lottery ticket imprinted with all of the groups of chance numerals;

the primary numerals of the group of primary numerals and the option numerals of each of the groups of option numerals are equal in number and are arranged in corresponding positions, and each option numeral of each group of option numerals being one of a) the same as a positionally corresponding one of the primary numerals of the group of primary numerals, and b) different from the positionally corresponding one of the primary numerals of the group of primary numerals by the numerical deviation factor, wherein the groups of chance numerals imprinted on the lottery ticket are different from one another and define the different chances to win of the lottery ticket; and the groups of chance numerals imprinted on the lottery ticket enable the player to compare each of the groups of chance numerals imprinted on the lottery ticket to a group of result numbers from the drawing for enabling the player to determine whether any of the groups of chance numerals imprinted on the lottery ticket is the same as the group of result numerals when the group of result numbers is received from the drawing.

8. The method of issuing a lottery ticket in advance of a lottery drawing in the playing of a lottery game according to claim 7, wherein the primary numerals of the group of primary numerals, and the option numerals of the groups of option numerals are selected from a group of numbers consisting of 0, 1, 2, 3, 4, 5, 6, 7, 8, and 9.

9. The method of issuing a lottery ticket in advance of a lottery drawing in the playing of a lottery game according to claim 8, wherein the numerical deviation factor is the number 1.

10. The method of issuing a lottery ticket in advance of a lottery drawing in the playing of a lottery game according to claim 8, wherein the numerical deviation factor is the number 2.

11. The method of issuing a lottery ticket in advance of a lottery drawing in the playing of a lottery game according to claim 8, wherein the primary numerals of the group of primary numerals, and the option numerals of each of the groups of option numerals are each at least three in number.

12. The method of conducting and playing a lottery game according to claim 1, wherein the step of inputting into the lottery computer system the group of primary numerals includes the player inputting into the lottery computer system the group of primary numerals.

13. The method of issuing a lottery ticket in advance of a lottery drawing in the playing of a lottery game according to claim 7, wherein the step of inputting into the lottery computer system the group of primary numerals includes the player inputting into the lottery computer system the group of primary numerals.

* * * * *